US008308001B2

(12) United States Patent
Lau et al.

(10) Patent No.: US 8,308,001 B2
(45) Date of Patent: Nov. 13, 2012

(54) FEEDING BOTTLE

(76) Inventors: Chantal Lau, Santa Fe, NM (US); David Nahmias, Paris (FR)

( * ) Notice: Subject to any disclaimer, the term of this patent is extended or adjusted under 35 U.S.C. 154(b) by 0 days.

(21) Appl. No.: 12/675,134

(22) PCT Filed: Aug. 29, 2008

(86) PCT No.: PCT/FR2008/001217

§ 371 (c)(1),
(2), (4) Date: Sep. 21, 2010

(87) PCT Pub. No.: WO2009/060145

PCT Pub. Date: May 14, 2009

(65) Prior Publication Data

US 2011/0000867 A1 Jan. 6, 2011

(30) Foreign Application Priority Data

Sep. 4, 2007 (FR) ..... 07 06190

(51) Int. Cl.
*A61J 9/04* (2006.01)
*A61J 11/00* (2006.01)

(52) U.S. Cl. ..... 215/11.5; 215/11.1; 215/365

(58) Field of Classification Search ..... 215/11.1, 215/11.5, 365
See application file for complete search history.

(56) References Cited

U.S. PATENT DOCUMENTS 1,056,113 A * 3/1913 Morgan ..... 215/11.1
2,372,281 A * 3/1945 Jordan ..... 215/11.5
2,744,646 A * 5/1956 Blackstone ..... 215/11.1
3,028,983 A 4/1962 Barr
3,092,276 A * 6/1963 Schaar ..... 215/11.1
3,139,064 A * 6/1964 Jean-Louis Harle ..... 116/309
3,532,242 A * 10/1970 Tibbs ..... 215/11.1
3,924,620 A * 12/1975 Seunevel ..... 215/11.1
4,548,157 A * 10/1985 Hevoyan ..... 116/308
5,263,599 A * 11/1993 Sklar ..... 215/11.1
5,531,338 A * 7/1996 Sklar ..... 215/11.1
5,544,766 A * 8/1996 Dunn et al. ..... 215/11.1
5,944,205 A 8/1999 LaJoie et al.
6,003,698 A * 12/1999 Morano ..... 215/11.1
2005/0023239 A1 2/2005 Lin
2005/0184022 A1 * 8/2005 Dunn et al. ..... 215/11.5
2006/0278597 A1 12/2006 Daugherty et al.

FOREIGN PATENT DOCUMENTS

DE 101 02 997 A1 7/2002
NL 1 018 590 C2 1/2003

OTHER PUBLICATIONS

International Search Report for Application No. PCT/FR2008/001217 dated Mar. 16, 2009.

* cited by examiner

*Primary Examiner* — Sue Weaver
(74) *Attorney, Agent, or Firm* — Alston & Bird LLP

(57) ABSTRACT

Feeding bottle (10) comprising a neck to which a teat (14) is attached, characterized in that it comprises at least two visual marks (20, 22) located on one and the same circumference near the neck or near the teat and separated from one another about the axis of the feeding bottle, one of these marks (20) defining one angular position of the feeding bottle (10) about its axis for which the other mark (22) indicates a point through which the free surface (24) of the liquid contained in the feeding bottle needs to pass in order for the hydrostatic pressure of the liquid at an outlet orifice (16) of the teat (14) to be substantially zero.

8 Claims, 2 Drawing Sheets

FEEDING BOTTLE

BACKGROUND OF THE INVENTION

This invention relates to the feeding of infants by means of feeding bottles, and more particularly the improvement of the safety and comfort of infants during feeding with a feeding bottle.

Feeding with a feeding bottle has for the infant risks of suffocating, choking or liquid going down the wrong way, when the rate or the pressure of the liquid flowing through the teat is too high.

The capacity of an infant to feed effectively and without risk depends on its ability to coordinate the steps of suction, deglutition and respiration, as well as its suction force. Although the majority of full-term babies are able to control and adjust the force and the duration of the suction in order to maintain an acceptable rate of liquid in light of their capacity to coordinate the three aforementioned steps, this is not the case for a few of them, in particular in the event of fatigue, and for the majority of premature babies or who have chronic diseases.

A person giving the feeding bottle has no way of knowing the rate that a baby is able to support and the suction force that then baby is able to develop, although this person is the only person in a position to control the rate of the liquid, not the infant itself. This rate depends in fact substantially on the hydrostatic pressure of the liquid at the outlet orifice of the teat of the feeding bottle, and therefore on the inclination of the feeding bottle in relation to the horizontal and to its level of filling. However it appears that less than one person in ten is able to correctly incline a feeding bottle during a feeding in order to maintain an acceptable rate of liquid for the infant. Faced with the uncontrolled flow of liquid flowing from the feeding bottle, the infant can have difficulties in getting its breath back or for resting, and as such runs the risk of suffocation, coughing, spittle, aspiration of liquid into the lungs or fatigue. Over time, the infant can develop an aversion for orality, or catch pneumonia due to the frequent penetration of liquid in the lungs.

It is therefore desirable to put the child in a position able to control himself the rate of the liquid flowing through the teat.

SUMMARY OF THE INVENTION

The invention has in particular for purpose to provide a solution that is simple, economical and effective for this problem, making it possible to prevent the aforementioned disadvantages.

It has for object a feeding bottle of which the hydrostatic pressure can be maintained at the outlet orifice of the teat at a substantially zero value, in such a way that the rate of liquid flowing through the teat can be controlled without difficulty by the infant who is feeding and that the liquid flows only if the baby is feeding.

It proposes for this purpose a feeding bottle, comprising a neck whereon is mounted a teat, characterized in that it comprises at least two visual marks located on the same circumference in the vicinity of the neck or of the teat and separated from one another around the axis of the feeding bottle, one of these marks defining an angular position of the feeding bottle around its axis for which the other mark indicates a point through which the free surface of the liquid contained in the feeding bottle needs to pass in order for the hydrostatic pressure of the liquid on an outlet orifice of the teat to be substantially zero.

The marks carried by the feeding bottle allow as such to indicate to the person who is holding the feeding bottle, the inclination to give to the feeding bottle so that the free surface of the liquid in the feeding bottle passes substantially through the outlet orifice of the teat in such a way that the hydrostatic pressure therein is substantially zero, and this regardless of the quantity of liquid contained in the feeding bottle. A first of the marks is intended to be placed upwards and as such indicates how to direct the feeding bottle around its axis, while a second mark indicates to the person holding the feeding bottle how to incline it in relation to the horizontal, so that the free surface of the liquid contained in the feeding bottle passes through this mark. The aforementioned marks as such allow the person giving the feeding bottle to know, at every instant and regardless of the filling rate of the feeding bottle, what inclination to give to the feeding bottle so that the infant can feed in the best conditions.

According to a first embodiment of the invention, the visual marks are formed or printed on a tightening ring of the teat on the neck. The marks are then formed as close as possible to the teat and make it possible to properly control the hydrostatic pressure in the feeding bottle during the feeding.

According to a second embodiment of the invention, the visual marks are formed or printed on the neck of the feeding bottle. This makes it possible in particular to benefit from the advantages procured by the invention by mounting any teat and any tightening ring on the feeding bottle, since the latter comprises the visual marks proposed by the invention.

According to a third embodiment of the invention, the visual marks are formed or printed on a rotatably mounted crown on the tightening ring of the teat. This alternative is particularly well suited for the use of an asymmetric teat, since it allows the user of the feeding bottle to correctly position the crown comprising the visual marks in relation to the teat, after fastening the teat on the feeding bottle.

According to a fourth embodiment of the invention, the visual marks are formed or printed on the teat of the feeding bottle. This alternative is well suited for teats of a large size of which at least one portion of the base remains visible during the feeding. This arrangement, wherein the marks are placed as close as possible to the outlet orifice of the teat, makes it possible to provide very precise indications as to the inclination to give to the feeding bottle, and as such offers a particularly effective means for reducing the hydrostatic pressure of the liquid at the outlet orifice of the teat.

Advantageously, the feeding bottle comprises a unidirectional air intake valve, and this valve forms one of the aforementioned marks. Such a valve makes it possible to prevent the establishment of a vacuum inside the feeding bottle as feeding takes place, and the problems of fatigue that stem from this for the infant. According to the invention, this valve also plays the role of a visual mark, for example in order to define the angular position of the feeding bottle around its axis. A visual mark can also be formed under the valve in order to indicate a maximum level of filling for the feeding bottle.

In a preferred embodiment, the feeding bottle comprises two visual symmetrical positioning marks of the free surface of the liquid, located on either side of an angular positioning mark of the feeding bottle. The presence of these two symmetrical marks makes the positioning of the feeding bottle as easy when the user is holding the feeding bottle with his right hand as when he is holding it with the left hand.

Typically, the angular separation between the positioning marks of the free surface of the liquid and the angular positioning of the feeding bottle is equal to approximately 45 degrees.

The invention also relates to a set of several feeding bottles of the type described hereinabove, wherein the colors of the visual marks differ from one feeding bottle to the next.

This makes it possible to distinguish the feeding bottles from one another and to find a particular feeding bottle in a set of feeding bottles.

BRIEF DESCRIPTION OF THE DRAWINGS

The invention shall be better understood and other details, advantages and characteristics of the latter shall appear more clearly when reading the following description provided by way of a non-restrictive example, in reference to the annexed drawings wherein.

DETAILED DESCRIPTION OF THE INVENTION

Figure 1:
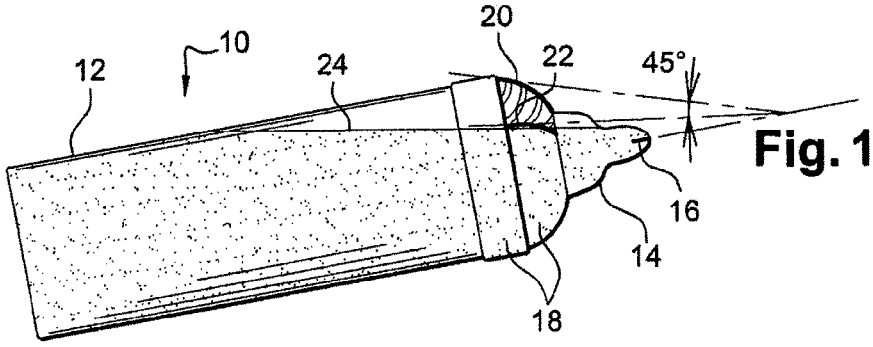
FIGS. 1 to 3 are side diagrammatical views of a feeding bottle according to a first embodiment of the invention.

FIG. 1 shows a feeding bottle 10 of the conventional type, comprising a transparent or translucent recipient 12 made of glass, plastic or analogous material, and a teat 14 comprising an outlet orifice 16, mounted on a neck of the recipient 12 by means of a tightening ring 18 which is screwed on the recipient.

The tightening ring 18 of the teat 14 comprises a first visual mark 20 formed for example of a colored dash, intended to be directed upwards during the feeding, and at least one second visual mark 22 formed for example of a colored dash, through which the user of the feeding bottle must pass the free surface 24 of the liquid contained in the feeding bottle in order to maintain a substantially zero hydrostatic pressure at the orifice 16 of the teat. These two marks 20 and 22 can be of a color or of any nature making it possible to distinguish them well from the rest of the ring 18.

The angular separation around the axis of the feeding bottle between the visual mark 20 and the mark 22 is approximately 45 degrees.

In a convenient way, the tightening ring 18 comprises another visual mark 22 symmetric of the first mark 22 (not visible in FIGS. 1 to 3), in order to allow for the use of the feeding bottle by holding it as well with one hand as with the other.

Figure 2:
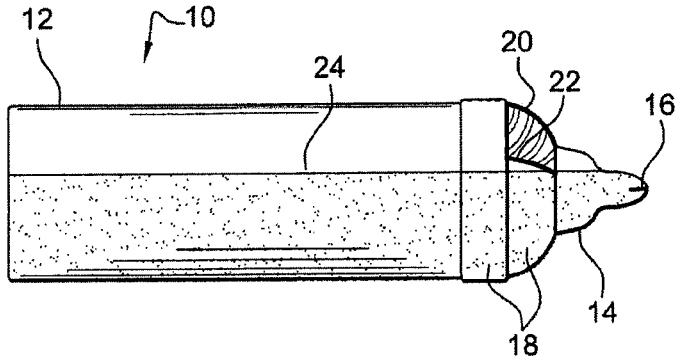
Figure 3:
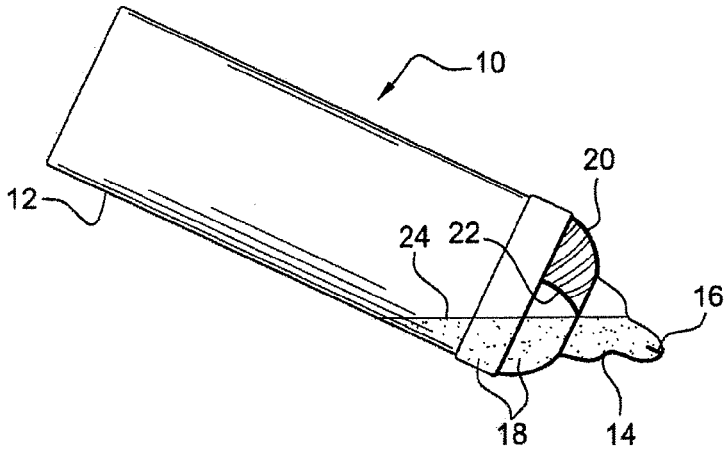

FIGS. 1 to 3 show the feeding bottle 10 in various positions of use corresponding to the different levels of filling of this feeding bottle.

In FIG. 1, the feeding bottle 10 is substantially filled to the maximum of its capacity. It must be slightly inclined in such a way as to direct the teat 14 upwards so that the free surface 24 of liquid passes through the second visual mark 22. It appears clearly in FIG. 1 that the free surface 24 thus passes in the vicinity of the orifice 16 of the teat 14, when ensures that the hydrostatic pressure at this level is substantially zero.

In FIG. 2, the feeding bottle 10 has been emptied a little of its contents and must now be held substantially horizontally in order to maintain the free surface 24 of the liquid on second visual mark 22 while still filling the teat. This free surface still passes in the vicinity of the orifice 16 of the teat 14 and the hydrostatic pressure as such remains very low.

Finally, in FIG. 3, there is only a small amount of liquid left in the feeding bottle 10, which must now be inclined in such a way as to direct the teat 14 downwards so that the free surface 24 of the liquid passes through the second visual mark 22.

The dashes which form the marks 22 have a length of a magnitude of 5 mm for example, in such a way that it is easy to maintain the free surface of the liquid in the feeding bottle at the level of one of these dashes.

Alternatively, the marks can be points or circles of a few millimeters in diameter, or any other mark that is easily visible formed on the tightening ring of the teat or on the neck of the feeding bottle.

Figure 4:
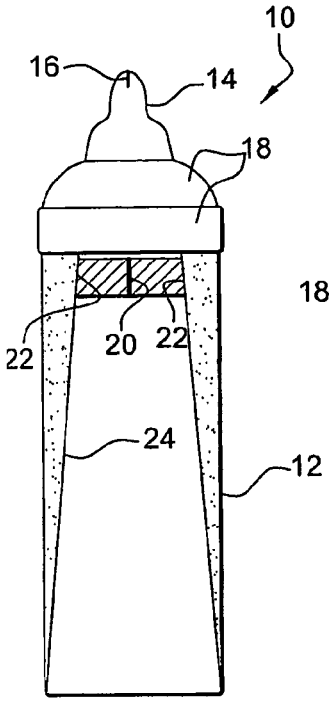
FIG. 4 is a top diagrammatical view of a feeding bottle according to an alternative of the invention.

FIG. 4 shows an alternative of the invention wherein the visual marks 20, 22 are not carried by the tightening ring 18 of the teat 14 but are formed on the body 12 of the feeding bottle 10, more preferably in the vicinity of its neck used for the mounting of the teat 14. It is as such possible to mount any teat of the symmetric type and any tightening ring on the neck of the feeding bottle 10 while still benefiting from the advantages procured by the invention.

In this case, the neck can comprise a colored annular strip, or have another aspect than the rest of the feeding bottle, which extends over approximately 90 degrees around the axis of the feeding bottle and of which the ends form the marks 22 while its median portion comprises a dash forming the mark 20.

Figure 5:
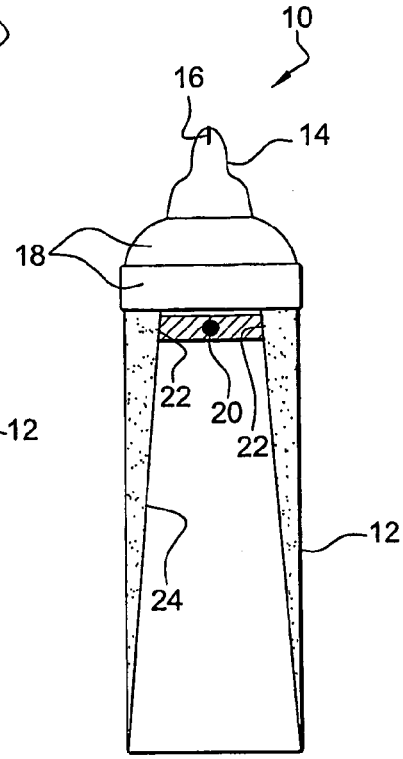
FIG. 5 is a top diagrammatical view of a feeding bottle according to another alternative of the invention.

Alternatively and such as is sown in FIG. 5, one of the marks, for example the central mark 20 for angular positioning of the feeding bottle around its axis, can be formed by a unidirectional air intake valve intended to prevent the establishment of a vacuum in the feeding bottle as feeding takes place, this vacuum creating a resistance to the flow of the liquid and being a cause of fatigue of the infant. Such a valve reduces the efforts required by the suction and increases the effectiveness of the feeding, without fatiguing the infant. This valve is located slightly above a visual mark indicating a maximum level of filling of the feeding bottle.

In order to respect the palate and the gums of infants, there are so-called asymmetric teats, which are not symmetrical in relation to a central axis, but nevertheless comprise a plane of symmetry intended to be directed vertically during feeding.

The use of such an asymmetric teat requires, after tightening on the feeding bottle, directing the visual marks 20, 22 around the axis of the feeding bottle in order to give them an adequate position in relation to the teat, i.e. a position wherein the angular orientation mark 20 of the feeding bottle, which must be directed upwards, passes through the plane of symmetry of the teat which itself must be directed vertically.

Figure 6:
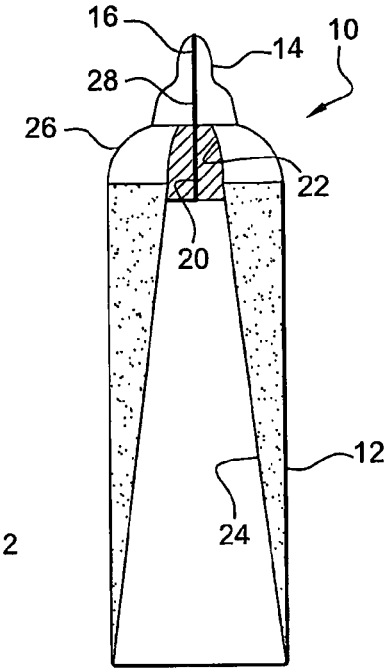
FIG. 6 is a top diagrammatical view of a feeding bottle according to yet another alternative of the invention.

For this, the alternative shown in FIG. 6 provides for the visual marks 20, 22 to be formed on a crown or an annular strip 26 which is rotatably mounted on the tightening ring of the teat. The teat used may carry a visual mark 28 indicating its plane of symmetry and intended to be directed upwards. It is then sufficient to align the visual angular orientation mark 20 formed on the crown with the aforementioned mark of the teat, after fastening of the latter, in order to be able to use the feeding bottle by taking advantage of the indications of the positioning mark(s) 22 of the free surface of the liquid.

Alternatively, the visual marks 20, 22 can be formed on a covering crown rotatably mounted on the neck of the feeding bottle.

In another alternative of the invention at least some of the visual marks 20, 22 are formed on the teat 14 itself.

Figure 7:
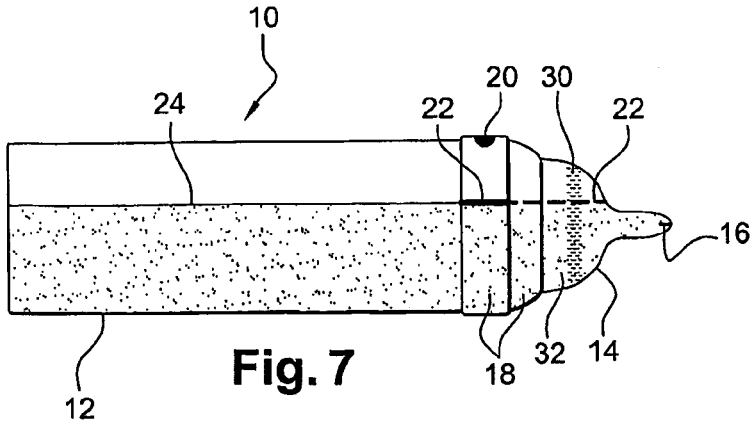
FIG. 7 is a side diagrammatical view of a feeding bottle according to yet another alternative of the invention.

FIG. 7 shows an example of an embodiment wherein the positioning mark 22 of the free surface of the liquid is formed on a teat 14 of large size. Another mark 22 and an angular orientation mark 20 can also be formed on the tightening ring 18 of the teat, the latter then being positioned in such a way that the marks 22 on the ring 18 and on the teat 14 are aligned.

The arrangement of one or of several marks 20, 22 on the teat is particularly advantageous with teats having dimensions that are sufficiently large so that during the feeding, a portion 32 at the base of the teat remains visible, the lips of the baby not being positioned beyond a level symbolized by the reference 30 in FIG. 7.

Generally, it is sufficient according to the invention that the person giving the feeding bottle, after having checked that the mark 20 is correctly positioned upwards, adjusts the inclination of the feeding bottle in such a way that the free surface 24 of liquid in the feeding bottle passes through the or one of the marks 22. In this way, the hydrostatic pressure is maintained close to zero at the orifice 16 of the teat 14, and the liquid will flow only if the infant is actually feeding, with no risks for the latter.

The invention claimed is:

1. Feeding bottle, comprising a neck whereon is mounted a teat and at least two visual positioning marks located on a same circumference in the vicinity of the neck or of the teat and separated from one another around the axis of the feeding bottle, one of these marks being configured to be positioned in an angular position around the axis of the feeding bottle for which an inclination of the bottle allows the other mark to pass through the free surface of the liquid contained in the feeding bottle in order for the free surface of the liquid to pass in the teat in the vicinity of an outlet orifice such that the hydrostatic pressure of the liquid at the outlet orifice of the teat is substantially zero.

2. Feeding bottle according to claim 1, wherein the visual marks are formed or printed on a tightening ring of the teat on the neck.

3. Feeding bottle according to claim 1, wherein the visual marks are formed or printed on the neck of the feeding bottle.

4. Feeding bottle according to claim 1, wherein the visual marks are formed or printed on a rotatably mounted crown on a tightening ring of the teat or on the neck of the feeding bottle.

5. Feeding bottle according to claim 1, wherein at least some of the visual marks are formed or printed on the teat of the feeding bottle.

6. Feeding bottle according to claim 1, and comprising a unidirectional air intake valve forming one of the aforementioned marks.

7. Feeding bottle according to claim 1, comprising two visual symmetrical marks for positioning the free surface of the liquid, located on either side of the angular positioning mark of the feeding bottle.

8. Feeding bottle according to claim 1, wherein the angular separation between the positioning marks of the free surface of the liquid and of the angular positioning of the feeding bottle is equal to approximately 45 degrees.

* * * * *